US005582904A

United States Patent [19]

Harrington

[11] Patent Number: 5,582,904

[45] Date of Patent: Dec. 10, 1996

[54] REWETTABLE POLYOLEFIN FIBER AND CORRESPONDING NONWOVENS

[75] Inventor: James H. Harrington, Gwennett, County, Ga.

[73] Assignee: Hercules Incorporated, Wilmington, Del.

[21] Appl. No.: 429,454

[22] Filed: May 2, 1995

Related U.S. Application Data

[63] Continuation of Ser. No. 301,526, Sep. 7, 1994, abandoned, which is a continuation of Ser. No. 119,906, Sep. 10, 1993, abandoned, which is a continuation of Ser. No. 386,317, Jul. 28, 1989, abandoned, which is a continuation-in-part of Ser. No. 359,617, Jun. 1, 1989, Pat. No. 5,033,172.

[51] Int. Cl.[6] ..... B32B 27/02; B32B 27/18; B32B 33/00; D04H 1/42

[52] U.S. Cl. ..... 428/224; 156/62.4; 156/62.8; 156/308.2; 428/286; 428/296; 428/300; 428/302; 428/373; 428/374; 524/231; 604/370; 604/372; 604/378; 604/381

[58] Field of Search ..... 156/62.4, 62.8, 156/308.2; 428/224, 296, 373, 374, 286; 604/370, 381

[56] References Cited

U.S. PATENT DOCUMENTS

| | | | |
|---|---|---|---|
| 3,454,519 | 7/1969 | Hulse et al. . | |
| 3,576,931 | 4/1971 | Chopra et al. . | |
| 3,700,544 | 10/1972 | Matsui . | |
| 4,013,617 | 3/1977 | Gordon et al. . | |
| 4,035,229 | 7/1977 | Rave | 162/167 |
| 4,082,730 | 4/1978 | Rave | 162/167 |
| 4,098,757 | 7/1978 | Gordon | 162/167 |
| 4,129,629 | 12/1978 | Gordon . | |
| 4,154,647 | 5/1979 | Rave | 162/164 |
| 4,154,757 | 5/1979 | Cooper et al. . | |
| 4,156,628 | 5/1979 | Rave . | |
| 4,210,556 | 7/1980 | Castro et al. . | |
| 4,273,892 | 6/1981 | Rave | 525/180 |
| 4,310,594 | 1/1982 | Yamazaki et al. . | |
| 4,314,040 | 2/1982 | Castro et al. | 525/6 |
| 4,417,999 | 11/1983 | Duffy . | |
| 4,516,628 | 5/1985 | Ward . | |
| 4,535,013 | 8/1985 | Kuhn . | |
| 4,578,414 | 3/1986 | Sawyer et al. | 524/310 |
| 4,607,072 | 8/1986 | Su | 524/242 |
| 4,636,436 | 1/1987 | Clementini | 428/364 |
| 4,637,945 | 1/1987 | Masui et al. | 428/290 |
| 4,702,947 | 10/1987 | Pall et al. | 428/36 |
| 4,785,042 | 11/1988 | Azuma et al. . | |
| 4,806,411 | 2/1989 | Mattingly et al. | 428/139 |
| 5,244,724 | 9/1993 | Antonacci et al. | 428/288 |

FOREIGN PATENT DOCUMENTS

| | | |
|---|---|---|
| 114379 | 8/1984 | European Pat. Off. . |
| 152883 | 8/1985 | European Pat. Off. . |
| 2154444 | 3/1987 | European Pat. Off. . |
| 1386869 | 12/1964 | France . |
| 85156 | 9/1985 | Luxembourg . |
| 1034337 | 6/1966 | United Kingdom . |

OTHER PUBLICATIONS

Encyclopedia of Polymer Science and Engineering, vol. 2; John Wiley & Sons, New York (US), pp. 100–103 (1985).
H. D. Junge, "Parat Index of Polymer Trade Names", VCH Verlagsgesellschaft mbh, Weinheim (DE), pp. 188 (1987).
European Office Action.
*Chemical Abstracts*: 104(18) 15076 (1989).
*Chemical Abstracts* 82(2):4988.
*Chemical Abstracts* 91(10):75300.
*Chemical Abstracts* 96(2):7348.
*Chemical Abstracts* 102(4):26234.
*Chemical Abstracts* 104(18):150706.
*Chemical Abstracts* 109(6):38983.

*Primary Examiner*—James C. Cannon
*Attorney, Agent, or Firm*—Joanne W. Patterson; Mark D. Kuller

[57] ABSTRACT

A method and corresponding product whereby hydrophobic polyolefin-containing nonwoven materials are provided with sustainable hydrophilic properties for rewet purposes by incorporation into the appropriate spin melt composition an effective amount of an alkoxylated fatty amine in optional combination with up to 60% by weight of primary fatty acid amide.

59 Claims, No Drawings

REWETTABLE POLYOLEFIN FIBER AND CORRESPONDING NONWOVENS

This application is a continuation of application Ser. No. 08/301,526, filed Sep. 7, 1994, now abandoned, which is a continuation of application Ser. No. 08/119,906, filed Sep. 10, 1993, now abandoned, which is a continuation of application Ser. No. 07/386,317, filed Jul. 28, 1989, now abandoned, which is a continuation-in-part of application Ser. No. 07/359,617, filed Jun. 1, 1989, now U.S. Pat. No. 5,033,172.

The present invention relates to a method for imparting sustainable hydrophilic properties to polyolefin-containing hydrophobic fiber and film, and to the corresponding fiber and nonwoven material obtained therefrom by incorporating one or more of a defined class of tertiary amines within the appropriate spin or cast melt resin composition.

BACKGROUND

While the manufacture and various uses of polyolefin-based fiber, fibrillated film, webs and corresponding nonwoven materials are well known in the textile art, attempts to broadly apply such knowledge to produce products in the area of personal hygiene, such as cover stocks for catamenial devices, disposable diapers, incontinence pads and the like, have met with limited success at best.

In general, such products must have a fluid-absorbent core, usually comprising one or more layers of fluid absorbent material such as wood pulp, rayon, gauze, tissue or the like, and, in some cases, synthetic hydrophilic material such as hydrophilic polyurethane foam.

The fluid-absorbing material is generally provided in the form of a thermally bonded pad, of wood pulp, fiber and conjugate fiber, which may have a rectangular or somewhat oval shape. To protect the clothing or areas around the user from being stained or wetted by fluids absorbed by the pad, it is generally backed by a fluid-impervious barrier sheet. In general, the absorbent product is positioned against the body with the hydrophilic material facing and contacting the body and the fluid impervious barrier layer facing the outside.

To enhance a sense of comfort, such absorbent products also generally employ a facing or cover stock material which covers the body-facing surface of the product. The purpose of this cover is two-fold, namely (1) to structurally contain a loosely packed core of absorbent material as above described and (2) to protect the body from continued direct contact with the wetted absorbent material. The facing or cover stock must, therefore, be very pervious to fluids on the side of the product that is placed against the body, and yet be essentially nonabsorbent, so as to actively promote the immediate transfer of substantially all of the fluid into the absorbent core material with minimal surface fluid retention by the cover stock and minimal lateral migration of fluid along the cover stock surface.

Such material should also feel smooth and soft to the touch. In addition, certain additional characteristics are also sometimes desired, such as visual opacity plus specific coloring and luster on the outer surfaces.

In order to obtain many of above-listed characteristics, however, it is imperative that cover stock utilizing essentially hydrophobic polymeric material, such as polyolefin fiber or film, be made at least temporarily hydrophilic and have the continuing ability to pass aqueous fluids through, even after several insults (i.e. wettings) without wash out or leach out of hydrophilic-promoting agents. This is particularly important in the case of diaper cover stock so as to avoid lateral liquid migration and side leakage without interfering with fabric bonding steps or the wet strength of the final product.

Based on teaching in the paper-making art, it is known that short term hydrophilicity can be imparted to hydrophobic polymers such as polyolefin fiber by using flash evaporation techniques and treating the resulting fiber or filament with hydrophilizing agents such as polyvinyl alcohol or various nitrogen-containing water-soluble polymers (ref. U.S. Pat. Nos. 4,156,628, 4,035,229, 4,082,730, 4,154,647, 4,156,628, 4,035,229, 4,273,892 and 4,578,414).

For personal hygiene purposes, however, the lack of significant resistance to wash out and leaching of art-recognized hydrophilic-promoting additives, plus interference with fiber or web bonding properties under high speed commercial operation, has justified continuing attempts to obtain improved hydrophilic-promoting additives and a longer term wettability. Such efforts include incorporating alkoxylated alkylphenols or corresponding polyoxyalkylenes into spun melt compositions (ref. U.S. Pat. No. 4,578,414). Serious high speed bonding and fluid control problems remain, however.

It is an object of the present invention to more effectively utilize inert hydrophobic polyolefin-containing nonwoven materials in the area of personal hygiene.

It is a further object of the present invention to efficiently utilize polyolefin-containing webs comprised of treated fiber, and/or treated fibrillated film as cover stock.

It is a still further object to obtain and retain hydrophilicity and liquid strike through properties in strong well bonded nonwoven hydrophobic materials such as continuous and/or staple fiber utilizing polyolefin component(s).

THE INVENTION

It is now found that hydrophilicity and liquid strike through properties of fiber (both continuous and staple), fibrillated film and corresponding nonwoven materials, particularly those comprised of essentially hydrophobic polyolefin-containing web(s) of fiber and/or fibrillated film, can be obtained and retained for an extended period by incorporating into the corresponding polyolefin-containing cast- or spin-melt composition, an effective amount of a modifier composition comprising (a) at least one N,N-polyalkoxylated 10–22 carbon fatty acid amine, inclusive of amine having 12–20 carbon and preferably 18 carbon linear straight chain moiety corresponding to that found in stearic acid or oleic acid; and (b) up to about 60%, including 0.1%–45% by weight of modifier composition, of a primary or secondary 10–22 carbon fatty acid amide such as stearamide.

After spinning or casting the resulting melt to obtain fiber or film, and processing the fiber (i.e. cutting and carding and/or spun bonding or melt blown) or fibrillated film in accordance with art-recognized techniques (ref U.S. Pat. Nos. 4,310,594 and 3,576,931), the corresponding webs can be oriented and bonded by conventional means to obtain the desired nonwoven material.

Such treated fiber can, if desired, be of a continuous or staple bicomponent fiber such as a sheath/core variety in which the polyolefin sheath spun melt contains the modifier composition or of the homogeneous (e.g. monoolefin) type.

For present purposes the term "effective amount", is here defined as falling within a range of about 0.1%–4.0% and preferably about 0.5–2.0% modifier composition, based on melt weight, the resulting fiber and/or fibrillated film being conveniently mixed, as desired, with about 0%–75% by web weight of modifier composition-free fiber and/or fibrillated film to obtain products or components thereof having desired degrees of hydrophilicity, fluid transference properties, strength and softness.

In particular, fiber, fibrillated film and corresponding hydrophobic nonwovens obtained therefrom are successfully modified by incorporating into the spun melt a modifier composition in which the above-defined "(a)" component is also conveniently represented as at least one alkoxylated amine compound of the general formula

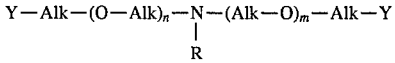

$$Y-Alk-(O-Alk)_n-\underset{\underset{R}{|}}{N}-(Alk-O)_m-Alk-Y \quad (1)$$

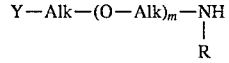

$$Y-Alk-(O-Alk)_m-\underset{\underset{R}{|}}{NH} \quad (2)$$

wherein the

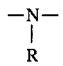

$$-\underset{\underset{R}{|}}{N}-$$

group is a 10–22 carbon fatty amine moiety in which

R has a linear configuration of a tallow amine, or a fatty amine corresponding to capric, lauric, palmitic, myristic, stearic, arachidic, and oleic acids;

Alk is defined as a 2–4 carbon methylene chain;

n and m are individually defined as a number ranging from about 0–26; which, in combination, are commensurate with a molecular weight ($M_w$) within a range of about 258 to about 2000; and Y is defined as a hydrophilic chemical end group such as —OH, —$SO_4$— and the like.

The optional "(b)" amide component of the modifier composition is preferably a primary or secondary fatty acid amide, such as one or more compound represented by the formulae

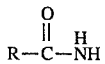

$$R-\overset{\overset{O}{\|}}{C}-\overset{H}{N}H \quad (3)$$

or

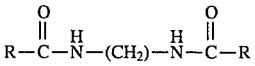

$$R-\overset{\overset{O}{\|}}{C}-\overset{H}{N}-(CH_2)-\overset{H}{N}-\overset{\overset{O}{\|}}{C}-R \quad (4)$$

wherein

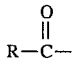

$$R-\overset{\overset{O}{\|}}{C}-$$

is individually defined as a 10–22 carbon fatty acid acyl moiety. Representative acids are, for instance, capric, palmitic, behenic, stearic and oleic acids, or corresponding N,N'-ethylene his counterparts as noted in formula (4).

A useful ratio of amine-to-amide, where desired for present purposes, is about 8-4 to 2–6 parts by weight of composition.

For present purposes, the above-defined modifier composition is best applied as a dry powdered ethoxylated amine material commercially obtainable, for instance, as Kemamine® AS-990, 974, 989, and 650(*1) alone or combined with up to 60% by modifier composition weight of a fatty acid amide such as Kemamide® S, or B(*1), and blended with a suitable polyolefin resin, in flake or pellet form, exemplified by an isotactic polypropylene or art-recognized hydrophobic copolymers thereof, the melt preferably having a weight average varying from about $3\times10^5$ to about $5\times10^5$, a molecular weight distribution of about 5.0–8.0, a melt flow rate of about 2.5 to about 4.0 g/10 minute, plus a spin temperature of about 220° C.–300° C. Such parameters can be modified, if necessary, to favor melt blown nonwovens and to obtain particularly desired characteristics such as high wet strength, softness, ease in using for high speed production, and the like.

*1 Commercial products of Humko Chemical Division of Witco Chemical Company of Memphis, Tenn.

As above noted, hydrophilic-induced webs used to fabricate nonwoven material such as cover stock can also usefully comprise conventional sheath/core or side-by-side bicomponent fiber or filament, alone or combined with treated or untreated homogenous-type fiber or filament and/or fibrillated film.

When using webs containing fiber of a sheath/core configuration, however, it is found particularly advantageous to incorporate the above-defined modifier composition primarily in the sheath component in order (a) to maximize surface availability, (b) to favor fiber surface-directed migration of the modifier and (c) to minimize the total amount of modifier composition required.

Also within the scope of the present invention is the use of nonwovens comprised of one or more bonded webs of modifier-treated polyolefin fiber- and/or fiber-like (fibrillated film) components having a mixed fiber denier of homogeneous and/or bicomponent types not exceeding about 40 dpf. Such webs preferably utilize fiber or filament within a range of about 0.1–40 dpf.

For present purposes, webs used to form nonwovens within the scope of the present invention are usefully formed by "Wet" or "Dry" Process and bonded together using bonding techniques with adhesive binders (U.S. Pat. No. 4,535,013), thermal bonding using calender rolls, hot air, sonic, laser, powder bonding, needle punch and the like, known to the art.

In addition, the resulting nonwoven material can be embossed and/or calender printed conventionally with various designs and colors, as desired, to increase loft, augment wet strength, and provide easy market identification.

Also includible within the instant invention are fibers utilizing art-recognized additives including pH stabilizers such as calcium stearate, antioxidants, degrading agents, pigments, including whiteners and colorants such as $TiO_2$ and the like. Generally such additives can individually vary, in amount, from about 0.1%–3% by weight of spin melt.

In addition, webs used in forming nonwovens within the scope of the present invention, are generally produced from one or more types of conventionally spun fibers or filaments having, for instance, round, delta, trilobal, or diamond cross sectional configurations.

Nonwoven cover stock, of the above defined types, can usefully vary in weight from about 10–40 gm $yd^2$ or even higher.

The following examples further illustrate, but do not limit the present invention:

EXAMPLE 1

A. Polypropylene in flake form and characterized as follows: (crystallinity 60%, $M_w 3.5\times10^5$, molecular weight distribution 6.4, and melt flow 3.2 g/10 minutes) is mixed in an impact blender at high speed for 20 minutes with 0.5% by weight of powdered Kemamine® AS 990(*2) as modifier composition. After blending, the mixture is fed into a 1½" extruder and spun through a 210 hole spinnerette at 285° C., air quenched, and processed to obtain 2.2 dpf 1.5" staple filament. The filament is then carded into webs weighing about 20 g/$yd^2$ and conventionally calendar bonded at 164° C. to obtain sample nonwoven material, which is then cut into test strips identified as A-1 for strike through, rewet and tensile-strength tests using Syn-Urine™ (*3). Test results are reported in Table I below as sample A-1, the control sample (C-1) being identically prepared and tested except for the absence of Kemamine 990 in the fiber.

(*2) an ethoxylated stearyl amine obtained commercially from Humko Chemical Division of Witco Chemical Corporation.

(*3) an aqueous commercial product obtained from Jayco Pharmaceutical Company of Camp Hill, Pa.

B. Filaments, webs and nonwoven materials are obtained in accordance with Example 1A, by incorporating 1.0% by weight of Kemamine AS 990 in the spun melt as modifier composition. The resulting 2.2 dpf fiber is cut to 1½ inch staple, carded into webs and thermally bonded as before to obtain a 20 g/yd$^2$ test nonwoven.

Strips of this nonwoven, identified as B-1, are tested for strike through, fewer, and strength as before; and results reported in Table 1.

C. Monofilament of 6 dpf are prepared, using the polypropylene flake of Example 1A admixed respectively with 0.5%, 1% and 2% by weight of Kemamine AS 990. Five (5) gram samples of each filament are loosely packed into identical 3 gram mesh baskets for sink-time tests in accordance with ASTM Method D-1117-79, increases in sink time or submergence time, after repeated insults being correlated to the degree of wash out and loss of hydrophilicity. Test results are reported in Table 2 as Samples D-1 through D-3 and the control (no modifier) is reported as C-2.

D. A bicomponent sheath/core polypropylene fiber of 6 dpf is prepared having a 30 wt % sheath, is prepared from isotactic polypropylene flake of Example 1A which is blended with 1% by polymer weight of Kemamine AS 990 and spun at 250° C. as a sheath or cover. The corresponding 70 wt. % or core is obtained from the corresponding unmodified isotactic polypropylene of Example 1A using an art-recognized spin pack arrangement (ref U.S. Pat. No. 3,700,544).

The resulting bicomponent fiber and modified homogeneous polypropylene fiber as (control) are tested in the manner of Example 1 C with respect to sink time, strike through, and rewet, and test results reported in Tables 3 and 4 as E-1 and C-3 (control).

E. Two batches of continuous spun isotactic polypropylene fiber containing, respectively 0.5% and 1.0% Kemamine modifier composition are prepared and spun (2.2 dpf) in accordance with Example 1 A, some of the fiber being crimped, cut to 1.5" staple, carded, and the resulting web thermally bonded as before to obtain test nonwoven material. The fiber, yarn and strips of nonwoven (20 gm/yd$^2$) are then tested for sink time as before, using identical weight samples lightly packed into 3 gram mesh basket. Test results are reported in Table 5 below.

F. Filaments, webs and corresponding nonwoven materials are produced in the manner of EX 1A, supra, using respectively 10%, 25%, 40%, 50%, 60% and 100% by weight of 0.75% Kemamine-treated 2.2 dpf 1.5 inch staple blended with 90%, 75%, 60%, 50%, 40% and 0% by weight, respectively, of untreated but otherwise identical 2.2 dpf 1.5 inch staple in a continuous blender, the blended staple is then carded, combined to form webs, thermally bonded and tested as before, the test results being reported in Table 6.

TABLE 1

| Sample # + Additive | # of insults | Strike-through (sec) | Strike Time (sec) Rewets | Rewets (g) | Tensile Strength (g/inch) (CD) | (MD) (g/inch |
|---|---|---|---|---|---|---|
| A-1 | 1 | 1-7 | 2.1 | .11 | 542 | 2198 |
| .5% | 2 | 2.1 | 2.4 | .10 | 542 | 2198 |
| Kemamine ® | 3 | 1.9 | 5.7 | .10 | 542 | 2198 |
| | 4 | 3.0 | 6.2 | .10 | 542 | 2198 |
| | 5 | 4.5 | 15.0 | .10 | 542 | 2198 |
| C-1 | 1 | 1.9 | 1.6 | .10 | 517 | 2015 |
| (Control) | 2 | 21.0 | >5 min | — | 517 | 2015 |
| | 3 | 122.0 | — | — | 517 | 2015 |
| | 4 | 283.0 | — | — | 517 | 2015 |
| | 5 | 290.0 | — | — | 517 | 2015 |
| B-1 | 1 | 1.8 | 1.8 | .10 | 565 | 2628 |
| | 2 | 1.8 | 2.8 | .10 | 565 | 2628 |
| | 3 | 2.4 | 4.0 | .10 | 565 | 2628 |
| | 4 | 4.2 | 10.0 | .10 | 565 | 2628 |
| | 5 | 3.3 | 11.0 | .10 | 565 | 2628 |

TABLE 2

| Sample # | % Kemamime ® 990 | Type | Insults | Sink Time (Sec) |
|---|---|---|---|---|
| C-2 | 0 | Monofil. | 1 | Did not sink |
| D-1 | 0.5#4 | Monofil. | 1 | 1.0 |
| | | Monofil. | 2 | 1.5 |
| | | Monofil. | 3 | 3.2 |
| | | Monofil. | 4 | 5.4 |
| | | Monofil. | 5 | 4.8 |
| D-2 | 0.5 | Monofil. | 1 | 31.0 |
| | | Monofil. | 2 | 20.0 |
| | | Monofil. | 3 | 6.4 |
| | | Monofil. | 4 | 14.7 |
| | | Monofil. | 5 | 20.0 |
| D-3 | 1.0 | Monofil. | 1 | 6.0 |
| | | Monofil. | 2 | 7.8 |
| | | Monofil. | 3 | 7.7 |
| | | Monofil. | 4 | 6.5 |
| | | Monofil. | 5 | 4.9 |
| D-4 | 2.0 | Monofil. | 1 | 11.0 |
| | | Monofil. | 2 | 4.0 |
| | | Monofil. | 3 | 12.0 |
| | | Monofil. | 4 | 5.0 |
| | | Monofil. | 5 | 5.0 |

TABLE 3

| Sample # | % Kemamine ® | Type | Insults | Sink Time (sec) |
|---|---|---|---|---|
| E-1 | 1% By Melt Wt. | Bicomp. | 1 | 1 |
| | | | 2 | 1.6 |
| | | | 3 | 3.5 |
| | | | 4 | 16.0 |
| | | | 5 | 25.0 |
| C-3 | 1% By Melt Wt. | Monofil | 1 | 3.7 |
| | | | 2 | 2.5 |
| | | | 3 | 6.9 |
| | | | 4 | 10.5 |
| | | | 5 | 20.6 |

TABLE 4

| Sample # | % Kemamine | Type | Insults | Strike-Through (sec) | Rewet (g) |
|---|---|---|---|---|---|
| E-1 | 1%/Melt Wt. (in Sheath) | Bicomp. | 1 | 1.3 | 0.12 |
| E-1 | 1%/Melt Wt. (in Sheath) | Bicomp. | 2 | 8.3 | 0.12 |
| E-1 | 1%/Melt Wt. (in Sheath) | Bicomp. | 3 | 18.4 | 0.12 |
| E-1 | 1%/Melt Wt. (in Sheath) | Bicomp. | 4 | 23.8 | 0.12 |
| E-1 | 1%/Melt Wt. (in Sheath) | Bicomp. | 5 | 16.7 | 0.12 |
| C-3 | 1%/Melt Wt. (in Sheath) | Homogeneous | 1 | 1.1 | 0.11 |
| C-3 | 1%/Melt Wt. (in Sheath) | Homogeneous | 2 | 2.6 | 0.12 |
| C-3 | 1%/Melt Wt. (in Sheath) | Homogeneous | 3 | 1.9 | 0.11 |
| C-3 | 1%/Melt Wt. (in Sheath) | Homogeneous | 4 | 13.1 | 0.11 |
| C-3 | 1%/Melt Wt. (in Sheath) | Homogeneous | 5 | 16.0 | 0.11 |

TABLE 5

| Samples | Sample Type | % Kemamine AS 990 Modifier | Sink Time (Sec) | No. Insults |
|---|---|---|---|---|
| F-1 (2.2 dpf) | Spin Yarn | 0.5 | 3.8 | 1 |
| | | | 3.8 | 2 |
| | | | 4.9 | 3 |
| | | | 6.9 | 4 |
| | | | 10.6 | 5 |
| F-1 | Staple | 0.5 | 8 | 1 |
| | | | 42 | 2 |
| | | | 48.7 | 3 |
| | | | 36 | 4 |
| | | | 29 | 5 |
| F-1 | Fabric | 0.5 | 6 | 1 |
| | | | 7 | 2 |
| | | | 28 | 3 |
| | | | 20 | 4 |
| | | | 30 | 5 |
| F-2 (2.1 dpf) | Spun Yarn | 1.0 | 3.1 | 1 |
| | | | 3.2 | 2 |
| | | | 3.9 | 3 |
| | | | 4.4 | 4 |
| | | | 4.5 | 5 |
| F-2 | Staple | 1.0 | 45.2 | 1 |
| | | | 105 | 2 |
| | | | 48.7 | 3 |
| | | | 67.0 | 4 |
| | | | 37.0 | 5 |
| F-2 | Fabric | 1.0 | 5.4 | 1 |
| | | | 7.7 | 2 |
| | | | 14.7 | 3 |
| | | | 28 | 4 |
| | | | 39 | 5 |
| C-4 Control (2.2 dpf) | Spin Yarn | 0.0 | 1.12 | 1 |
| | | | 4.0 | 2 |
| | | | 60.0 | 3 |
| | | | 600.0 | 4 |
| | | | >3600.0 | 5 |
| C-4 Control (2.2 dpf) | Staple | 0.0 | 1.0 | 1 |
| | | | 72.0 | 2 |
| | | | >300 | 3 |
| | | | — | 4 |
| | | | — | 5 |
| C-4 Control (2.2 dpf) | Fabric | 0.0 | 2.96 | 1 |
| | | | 600 | 2 |
| | | | >4 hrs. | 3 |
| | | | — | 4 |
| | | | — | 5 |

TABLE 6

WETTABLE POLYPROPYLENE FABRICS REWETTABLE/NON-REWETTABLE FIBER BLENDS

| Samples | Rewettable Fiber (%) | Insults | Strike/Rewet Time (sec.) | Rewets (G.) |
|---|---|---|---|---|
| G-1 | 10 | 1 | 1.95 | 0.1 |
| | | 2 | 186.7 | 0.11 |
| | | 3 | 169.6 | 0.11 |
| | | 4 | 274.9 | 0.11 |
| | | 5 | 254.5 | 0.11 |
| G-2 | 25 | 1 | 1.75 | 0.11 |
| | | 2 | 57.4 | 0.11 |
| | | 3 | 62 | 0.11 |
| | | 4 | 239.5 | 0.11 |
| | | 5 | 264.6 | .0.11 |
| G-3 | 40 | 1 | 1.7 | 0.11 |
| | | 2 | 24.6 | 0.11 |
| | | 3 | 26.6 | 0.11 |
| | | 4 | 139 | 0.11 |
| | | 5 | 160 | 0.11 |
| G-4 | 50 | 1 | 1.6 | 0.12 |
| | | 2 | 15.5 | 0.13 |
| | | 3 | 10.6 | 0.12 |
| | | 4 | 95 | 0.13 |
| | | 5 | 185.1 | 0.13 |
| G-5 | 60 | 1 | 1.3 | 0.11 |
| | | 2 | 8.5 | 0.13 |
| | | 3 | 7.5 | 0.13 |
| | | 4 | 59 | 0.13 |
| | | 5 | 180.2 | 0.13 |
| G-6 | 100 | 1 | 1.2 | 0.11 |
| | | 2 | 3.6 | 0.11 |
| | | 3 | 4.5 | 0.11 |
| | | 4 | 11.3 | 0.11 |
| | | 5 | 54.5 | 0.12 |
| C-5 (Control) | 0 | 1 | 1.6 | 0.11 |
| | | 2 | 300 | |
| | | 3 | 300 | |
| | | 4 | 300 | |
| | | 5 | 300 | |

What is claimed is:

1. A nonwoven material comprised of at least one web containing polyolefin sheath core bicomponent fiber, the sheath component of which comprises the additive composition of about 0.1% to 4% by weight of at least one alkoxylated amine selected from the group consisting of $$Y-Alk-(O-Alk)_n-\underset{\underset{R}{|}}{N}-(Alk-O)_m-Alk-Y$$

and $$Y-Alk-(O-Alk)_m-\underset{\underset{R}{|}}{NH}$$

wherein the $$-\underset{\underset{R}{|}}{N}-$$

group therein is a 10–22 carbon fatty amine moiety in which the R radical has a linear straight chain configuration;

Alk is defined as a 2–4 carbon methylene chain;

n and m are individually defined as a positive number ranging from about 1 to about 26 which, in combination, are commensurate with a molecular weight within a range of from about 258 to about 2000; and y is defined as a hydrophilic chemical end group; and up to about 60%, by weight of the additive composition, of a primary or secondary 10–22 carbon fatty acid amide.

2. The nonwoven material of claim 1, wherein the amide is present in an amount of 0.1 to about 60% by weight of the additive composition.

3. The nonwoven material of claim 2, wherein the amide is present in an amount of 0.1 to about 45% by weight of the additive composition.

4. The nonwoven material of claim 1, wherein the fatty acid amide has the formula $$R-\overset{\overset{O}{||}}{C}-\overset{H}{N}H$$

or $$R-\overset{\overset{O}{||}}{C}-\overset{H}{N}-(CH_2)-\overset{H}{N}-\overset{\overset{O}{||}}{C}-R$$

where $$R-\overset{\overset{O}{||}}{C}-$$

is a 10–22 carbon fatty acid acyl moiety.

5. The nonwoven material of claim 4, wherein the fatty acid acyl moiety is selected from the group consisting of capric, lauric, myristic, stearic, oleic, palmitic, and behenic acid acyl moieties.

6. The nonwoven material of claim 5, wherein the fatty acid amide is stearamide.

7. The nonwoven material of claim 2, wherein the ratio of amine to amide in the additive composition is from about 8:4 to about 2:6 by weight.

8. The nonwoven material of claim 1, wherein the fatty amine moiety is a 12 to 20 carbon amine moiety.

9. The nonwoven material of claim 8, wherein the fatty amine moiety is an 18 carbon amine moiety.

10. The nonwoven material of claim 1, wherein the additive composition is present in an amount of 0.5 to about 2.0% by weight.

11. The nonwoven material of claim 1, wherein the polyolefin has a weight average molecular weight of about $3\times10^5$ to about $5\times10^5$.

12. The nonwoven material of claim 1, wherein the polyolefin in the sheath of the bicomponent fiber is isotactic polypropylene.

13. The nonwoven material of claim 12, wherein the core of the bicomponent fiber is isotactic polypropylene that does not contain the additive composition.

14. The nonwoven material of claim 1, wherein the polyolefin in the sheath of the bicomponent fiber is polyethylene.

15. A nonwoven fibrous material wherein the fibers are spun from a polymer melt and the melt consists essentially of a blend of a polyolefin and from 0.1% to about 4.0%, based on the weight of the polymer melt, of an additive composition comprising (a) at least one N,N-polyalkoxylated 10–22 carbon fatty amine, and (b) 0.1% to about 60% by weight of the additive composition, of a primary or secondary 10–22 carbon fatty acid amide.

16. The nonwoven material of claim 15, wherein the additive composition is present in an amount of 0.5 to about 2.0%.

17. The nonwoven material of claim 15, wherein the polyolefin is isotactic polypropylene.

18. The nonwoven material of claim 15, wherein the fatty amine has the formula $$Y-Alk-(O-Alk)_n-\underset{\underset{R}{|}}{N}-(Alk-O)_m-Alk-Y$$

or $$Y-Alk-(O-Alk)_m-\underset{\underset{R}{|}}{NH}$$

wherein the $$-\underset{\underset{R}{|}}{N}-$$

group is a 10–22 carbon fatty amine moiety in which

R group has a linear configuration;

Alk is a 2–4 carbon methylene chain;

n and m are positive numbers ranging from about 1 to about 26, which, in combination, are commensurate with a molecular weight of from about 258 to about 2000; and Y is a hydrophilic chemical end group.

19. The nonwoven material of claim 18, wherein the fatty amine moiety is a 12–20 carbon amine moiety.

20. The nonwoven material of claim 19, wherein the fatty amine moiety is an 18 carbon amine moiety.

21. The nonwoven material of claim 15, wherein the fatty acid amide is present in an amount of 0.1 to about 45%.

22. The nonwoven material of claim 15, wherein the fatty acid amide has the formula $$R-\overset{\overset{O}{||}}{C}-\overset{H}{N}H$$

or $$R-\overset{\overset{O}{||}}{C}-\overset{H}{N}-(CH_2)-\overset{H}{N}-\overset{\overset{O}{||}}{C}-R$$

wherein $$R-\overset{\overset{\displaystyle O}{\|}}{C}-$$

is a 10–22 carbon fatty acid acyl moiety.

23. The nonwoven material of claim 22, wherein the fatty acid acyl moiety is selected from the group consisting of capric, palmitic, behenic, stearic, oleic, lauric, and myristic acid acyl moieties.

24. The nonwoven material of claim 23, wherein the fatty acid amide is stearamide.

25. The nonwoven material of claim 15, wherein the ratio of amine to amide is from about 8:4 to about 2:6 by weight.

26. The nonwoven material of claim 15, wherein the fibers are continuous fibers.

27. The nonwoven material of claim 26, wherein the fibers are isotactic polypropylene fibers.

28. The nonwoven material of claim 15, wherein the fibers are staple bicomponent fibers.

29. The nonwoven material of claim 28, wherein the bicomponent fibers are sheath/core fibers.

30. The nonwoven material of claim 29, wherein the polyolefin is in the sheath of the bicomponent fibers.

31. The nonwoven material of claim 30, wherein the sheath of the bicomponent fibers comprises isotactic polypropylene and the additive composition.

32. The nonwoven material of claim 31, wherein the core of the bicomponent fibers comprises isotactic polypropylene without the additive composition.

33. The nonwoven material of claim 30, wherein the sheath of the bicomponent fibers comprises a blend of polyethylene and the additive composition.

34. An article of manufacture comprising:

(a) a first layer comprising a nonwoven fibrous material wherein the fibers are spun from a polymer melt and the melt consists essentially of a blend of a polyolefin and from 0.1% to about 4.0%, based on the weight of the polymer melt, of an additive composition comprising (1) at least one N, N-polyalkoxylated 10–22 carbon fatty amine, and (2) a positive amount up to about 60% by weight of the additive composition, of a primary or secondary 10–22 carbon fatty acid amide, (b) an absorbent core positioned between (a) and (c), and (c) a liquid impervious backing sheet.

35. The article of claim 34, wherein the additive composition is present in an amount of 0.5 to about 2.0%.

36. The article of claim 34, wherein the polyolefin is isotactic polypropylene.

37. The article of claim 34, wherein the fatty amine has the formula $$Y-Alk-(O-Alk)_n-\underset{\underset{\displaystyle R}{|}}{N}-(Alk-O)_m-Alk-Y$$

or $$Y-Alk-(O-Alk)_m-\underset{\underset{\displaystyle R}{|}}{NH}$$

wherein the $$-\underset{\underset{\displaystyle R}{|}}{N}-$$

group is a 10–22 carbon fatty amine moiety in which

R has a linear configuration;

Alk is a 2–4 carbon methylene chain;

n and m are positive numbers from about 1 to about 26, which, in combination, are commensurate with a molecular weight of from about 258 to about 2000; and Y is a hydrophilic chemical end group.

38. The article of claim 37, wherein the fatty amine moiety is a 12–20 carbon amine moiety.

39. The article of claim 38, wherein the fatty amine moiety is an 18 carbon amine moiety.

40. The article of claim 34, wherein the amide is present in an amount of 0.1 to about 60%.

41. The article of claim 40, wherein the amide is present in an amount of 0.1 to about 45%.

42. The article of claim 34, wherein the fatty acid amide has the formula $$R-\overset{\overset{\displaystyle O}{\|}}{C}-\overset{\overset{\displaystyle H}{|}}{N}H$$

or $$R-\overset{\overset{\displaystyle O}{\|}}{C}-\overset{\overset{\displaystyle H}{|}}{N}-(CH_2)-\overset{\overset{\displaystyle H}{|}}{N}-\overset{\overset{\displaystyle O}{\|}}{C}-R$$

wherein $$R-\overset{\overset{\displaystyle O}{\|}}{C}-$$

is a 10–22 carbon fatty acid acyl moiety.

43. The article of claim 42, wherein the fatty acid acyl moiety is selected from the group consisting of capric, palmitic, behenic, stearic, oleic, lauric, and myristic acid acyl moieties.

44. The article of claim 43, wherein the fatty acid amide is stearamide.

45. The article of claim 40, wherein the ratio of amine to amide is from about 8:4 to about 2:6 by weight.

46. The article of claim 34, wherein the polyolefin fibers are continuous fibers.

47. The article of claim 46, wherein the fibers are isotactic polypropylene fibers.

48. The article of claim 34, wherein the polyolefin fibers are staple bicomponent fibers.

49. The article of claim 48, wherein the bicomponent fibers are sheath/core fibers.

50. The article of claim 49, wherein the polyolefin is in the sheath of the bicomponent fibers.

51. The article of claim 50, wherein the sheath comprises a blend of isotactic polypropylene and the additive composition.

52. The article of claim 51, wherein the core of the bicomponent fibers comprises isotactic polypropylene without the additive composition.

53. The article of claim 50, wherein the sheath comprises a blend of polythethylene and the additive composition.

54. The article of claim 34, wherein the polyolefin fibers have a mixed fiber denier.

55. The article of claim 54, wherein the denier of the fibers is from 0.1 to about 40 denier per fiber.

56. The article of claim 34, wherein the article is a diaper.

57. The article of claim 34, wherein the polyolefin has a weight average molecular weight of about $3\times10^5$ to about $5\times10^5$.

58. The article of claim 34, wherein the polyolefin fibers are blended with up to 75% of additive-free polyolefin fibers.

59. A process for preparing a nonwoven material comprising (1) providing fibers that have been spun from a polymer melt, said fibers consisting essentially of a blend of a polyolefin and from 0.1% to about 4.0%, based on the weight of the polymer melt, of an additive composition comprising (a) at least one N, N-polyalkoxylated 10–22 carbon fatty amine, and (b) 0.1% to about 60% by weight of the additive composition, of a primary or secondary 10–22 carbon fatty acid amide, (2) laying down the fibers to form at least one fiber web, (3) bonding the web or webs to form a nonwoven material.

* * * * *